US008690015B2

(12) United States Patent
Mainville et al.

(10) Patent No.: US 8,690,015 B2
(45) Date of Patent: Apr. 8, 2014

(54) DISPENSER FOR OIL AND VINEGAR

(75) Inventors: Patrick Mainville, Montreal (CA); Benoit Orban, St-Lambert (CA); François Gaucher, Montreal (CA); André Quévillon, Blainville (CA)

(73) Assignee: Trudeau Corporation 1889 Inc., Boucherville, Quebec (CA)

( * ) Notice: Subject to any disclaimer, the term of this patent is extended or adjusted under 35 U.S.C. 154(b) by 190 days.

(21) Appl. No.: 13/034,742

(22) Filed: Feb. 25, 2011

(65) Prior Publication Data

US 2011/0253745 A1 Oct. 20, 2011

Related U.S. Application Data

(60) Provisional application No. 61/308,614, filed on Feb. 26, 2010.

(51) Int. Cl.
*B65D 47/06* (2006.01)
*B65D 81/32* (2006.01)

(52) U.S. Cl.
CPC ..... *B65D 47/06* (2013.01)
USPC ..... 222/129; 222/481.5; 251/4; 251/7

(58) Field of Classification Search
USPC ..... 222/481.5, 478, 571, 567, 129, 152, 222/173, 182, 192, 464.1, 375, 540, 569, 222/572, 142.5, 271; 251/4, 7, 9, 10
See application file for complete search history.

(56) References Cited

U.S. PATENT DOCUMENTS 2,197,995 A * 4/1940 Crowley ..... 251/7
3,347,420 A * 10/1967 Donoghue ..... 222/129

(Continued)

FOREIGN PATENT DOCUMENTS

DE 3514133 10/1986
EP 0342453 11/1989

(Continued)

OTHER PUBLICATIONS

European Search Report dated Jun. 20, 2011 for EP Application No. 11155853.2.

*Primary Examiner* — Kevin P Shaver
*Assistant Examiner* — Michael J Melaragno
(74) *Attorney, Agent, or Firm* — RatnerPrestia

(57) ABSTRACT

A dispenser for oil and vinegar, the dispenser comprising: (a) an outer container defining an internal space for receiving oil and having a top rim defining an opening; (b) an inner container defining an internal space for receiving vinegar, the inner container being at least partially located within the internal space of the outer container, the inner container having a shoulder projecting outwardly and being located above the top rim of the outer container; (c) a cap having a top wall and a peripheral wall for enclosing the top rim of the outer container and the shoulder of the inner container, the top wall and peripheral wall defining an internal space; (d) a first tube having a bottom end defining a bottom opening facing the internal space of the outer container and a top end defining a top opening opened to the atmosphere, wherein the first tube defines a first passage for allowing fluid communication between the internal space of the outer container and the atmosphere; and (e) a second tube having a bottom end defining a bottom opening facing the internal space of the inner container and a top end defining a top opening opened to the atmosphere, wherein the second tube defines a second passage for allowing fluid communication between the internal space of the inner container and the atmosphere.

26 Claims, 5 Drawing Sheets

(56) References Cited

U.S. PATENT DOCUMENTS

| | | | | |
|---|---|---|---|---|
| 3,613,955 | A * | 10/1971 | Wetherell, Jr. | 222/83 |
| 4,531,912 | A * | 7/1985 | Schuss et al. | 433/80 |
| 4,960,259 | A * | 10/1990 | Sunnanvader et al. | 251/7 |
| 4,993,595 | A | 2/1991 | Bertram | |
| 5,062,550 | A * | 11/1991 | Singh | 222/80 |
| 5,511,700 | A * | 4/1996 | Ouno | 222/481.5 |
| 5,931,356 | A * | 8/1999 | Lillelund et al. | 222/485 |
| 6,321,947 | B2 * | 11/2001 | Gross et al. | 222/145.1 |
| 6,361,016 | B1 * | 3/2002 | Schulz | 251/7 |
| 6,609,639 | B1 * | 8/2003 | Genthon | 222/571 |
| 7,594,589 | B2 * | 9/2009 | Potts et al. | 220/500 |
| 7,665,631 | B2 * | 2/2010 | Pikowski | 222/129 |
| 7,934,624 | B2 * | 5/2011 | Seelhofer | 222/129 |
| 8,302,817 | B2 * | 11/2012 | Saravis | 222/135 |
| 2005/0150910 | A1 * | 7/2005 | Groys | 222/189.11 |
| 2008/0277419 | A1 * | 11/2008 | Holcomb et al. | 222/129 |
| 2009/0026222 | A1 * | 1/2009 | Seelhofer | 222/129 |

FOREIGN PATENT DOCUMENTS

| | | |
|---|---|---|
| EP | 1367003 | 12/2003 |
| EP | 1826144 | 8/2007 |
| WO | 2007053970 | 5/2007 |

* cited by examiner

DISPENSER FOR OIL AND VINEGAR

CROSS REFERENCE TO RELATED APPLICATIONS

This application claims the benefit under 35 USC §119(e) of U.S. Provisional Patent Application 61/308,614 filed on Feb. 26, 2010. The contents of the above-mentioned patent application are incorporated herein by reference.

FIELD OF THE INVENTION

The present invention relates to a dispenser for oil and vinegar.

BACKGROUND

Oils (e.g., olive oil) and vinegars (e.g., balsamic vinegar) are two very popular ingredients for salad dressings. These ingredients are typically combined by a user in different relative amounts in proportion based on his or her taste. Because these two ingredients are typically stored in separate containers, mixing them requires the use of a mixing receptacle (e.g., a mixing bowl) where both can be brought together. Alternatively, the oil and vinegar can be applied directly to the salad from their respective containers or via a dispenser, such as a gasket/stopper that is centrally pierced by a hollow tube that extends into the container and allows its contents to flow out when the container is rotated towards the horizontal plane.

One obvious deficiency with this type of dispenser is that each container requires its own dispenser, which is both inconvenient and costly for users. While there are dispensers that include an oil container and a vinegar container integrated together, these dispensers have two different external tubes on each side for pouring separately the oil on one side and the vinegar on the other side.

Another known deficiency is the user difficulty in controlling the relative amounts of oil/vinegar dispensed.

Therefore, there is a need for a dispenser of oil and vinegar that stores and dispenses oil and vinegar in a single dispenser and also allows the user to adjust the amounts of oil and vinegar applied as a salad dressing to their liking.

SUMMARY OF THE INVENTION

As embodied and broadly described herein, the present invention provides a dispenser for oil and vinegar, the dispenser comprising: (a) an outer container having a bottom wall and a peripheral wall defining an internal space for receiving oil, the outer container having a top rim defining an opening; (b) an inner container having a bottom wall and a peripheral wall defining an internal space for receiving vinegar, the inner container being at least partially located within the internal space of the outer container, the inner container having a shoulder projecting outwardly and being located above the top rim of the outer container; (c) a cap having a top wall and a peripheral wall for enclosing the top rim of the outer container and the shoulder of the inner container, the top wall and peripheral wall defining an internal space; (d) a first tube having a bottom end defining a bottom opening facing the internal space of the outer container and a top end defining a top opening opened to the atmosphere, wherein the first tube defines a first passage for allowing fluid communication between the internal space of the outer container and the atmosphere; and (e) a second tube having a bottom end defining a bottom opening facing the internal space of the inner container and a top end defining a top opening opened to the atmosphere, wherein the second tube defines a second passage for allowing fluid communication between the internal space of the inner container and the atmosphere; wherein, in use, when a user tilts the dispenser, the first and second tubes allow separate and simultaneous dispensing of oil and vinegar through the first and second passages respectively.

The invention also provides a dispenser for oil and vinegar, the dispenser comprising: (a) an outer container having a bottom wall and a peripheral wall defining an internal space for receiving oil, the outer container having a top rim defining an opening; (b) an inner container having a bottom wall and a peripheral wall defining an internal space for receiving vinegar, the inner container being at least partially located within the internal space of the outer container, the inner container having a plurality of arms that project outwardly from the peripheral wall up to a peripheral ring, the peripheral ring having a shoulder projecting outwardly and being located above the top rim of the outer container, the inner container having a top rim with a portion located above the shoulder of the inner container and defining an opening, and wherein the inner container has a plurality of openings defined between the peripheral wall, plurality of arms and peripheral ring; (c) a cap having a top wall and a peripheral wall for covering the top rim of the outer container and the shoulder of the inner container, the top wall and peripheral wall defining an internal space; (d) a first tube having a bottom end defining a bottom opening facing the internal space of the outer container and a top end defining a top opening opened to the atmosphere, wherein the first tube defines a first passage for allowing fluid communication between the internal space of the outer container and the atmosphere; (e) a second tube having a bottom end defining a bottom opening facing the internal space of the inner container and a top end defining a top opening opened to the atmosphere, wherein the second tube defines a second passage for allowing fluid communication between the internal space of the inner container and the atmosphere; (f) a first aeration tube having a bottom end defining a bottom opening facing the internal space of the outer container and a top end defining a top opening located in the internal space of the cap, wherein the first aeration tube defines a first air passage; and (g) a second aeration tube having a bottom end defining a bottom opening facing the internal space of the inner container and a top end defining a top opening located in the internal space of the cap, wherein the second aeration tube defines a second air passage; wherein the first and second tubes and the first and second aeration tubes are part of a unitary member, the unitary member having a base for covering the shoulder of the inner container and overlapping the plurality of openings and first and second inner peripheral walls defining therebetween a groove for receiving the top rim of the inner container such that in use, when the user tilts the dispenser, the first and second tubes allow separate and simultaneous dispensing of oil and vinegar wherein oil contained in the internal space of the outer container passes through at least one of the plurality of openings and is directed towards the bottom opening of the first tube for allowing dispending of the oil through the first passage of the first tube while air can also penetrate into the internal space of the outer container via the first air passage and wherein vinegar contained in the internal space of the inner container is directed towards said bottom opening of said second tube for allowing dispensing of the vinegar through said second passage of said second tube while air can also penetrate into said internal space of said inner container via said second air passage.

This and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of examples of implementation of the present invention is provided hereinbelow with reference to the following drawings, in which.

Figure 1:
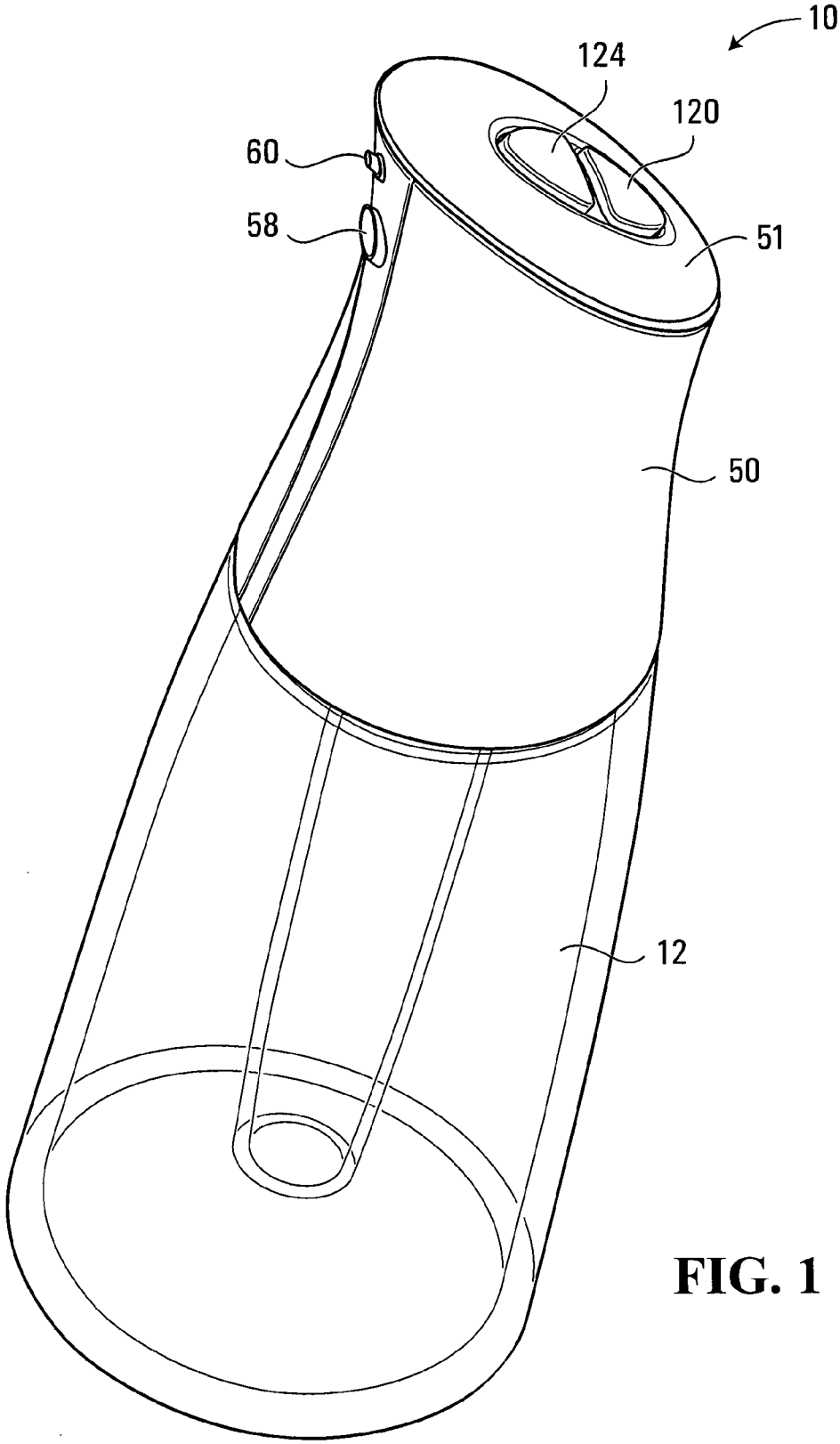
FIG. 1 is a perspective view of a dispenser for oil and vinegar in accordance with an embodiment of the invention.
Figure 2:
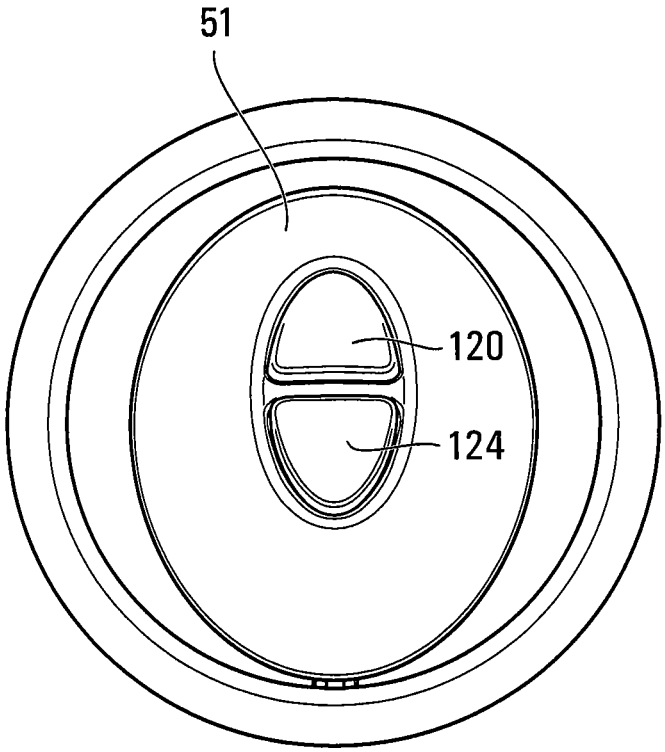
FIG. 2 is a top view of the dispenser of FIG. 1

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION OF EMBODIMENTS

To facilitate the description, any reference numeral designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

Unless otherwise indicated, the drawings are intended to be read together with the specification, and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure. Similarly, the terms "inwardly," "outwardly" and "radially" generally refer to the orientation of a surface relative to its axis of elongation, or axis of rotation, as appropriate.

In the figures, a dispenser 10 in accordance with the invention is shown, the dispenser 10 being suitable for dispensing oil and vinegar simultaneously.

The dispenser 10 has an outer container 12 having a bottom wall 14 and a peripheral wall 16 defining an internal space 18 for receiving the oil. The outer container 12 also comprises a neck 20 provided at its top end, the neck 20 having external threads 22 and a top rim 24 defining an opening 26.

Figure 3:
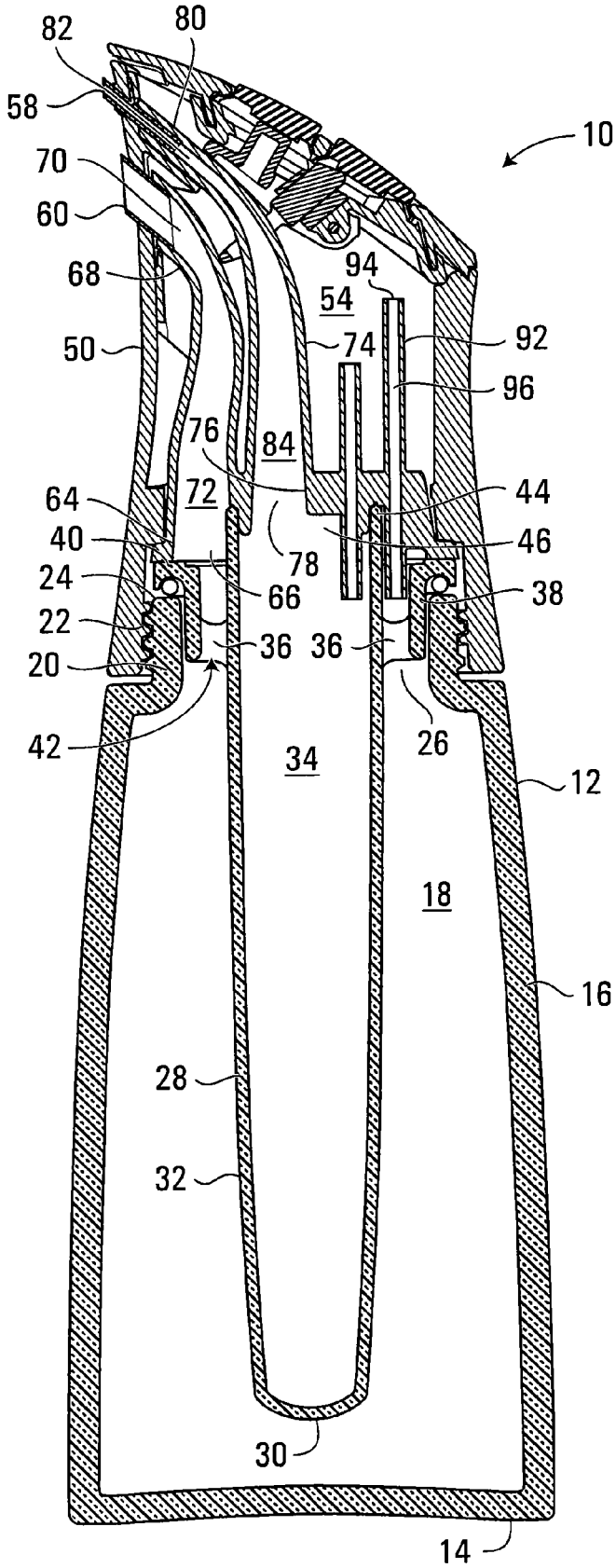
FIG. 3 is a cross-sectional view of the dispenser of FIG. 1.
Figure 4B:
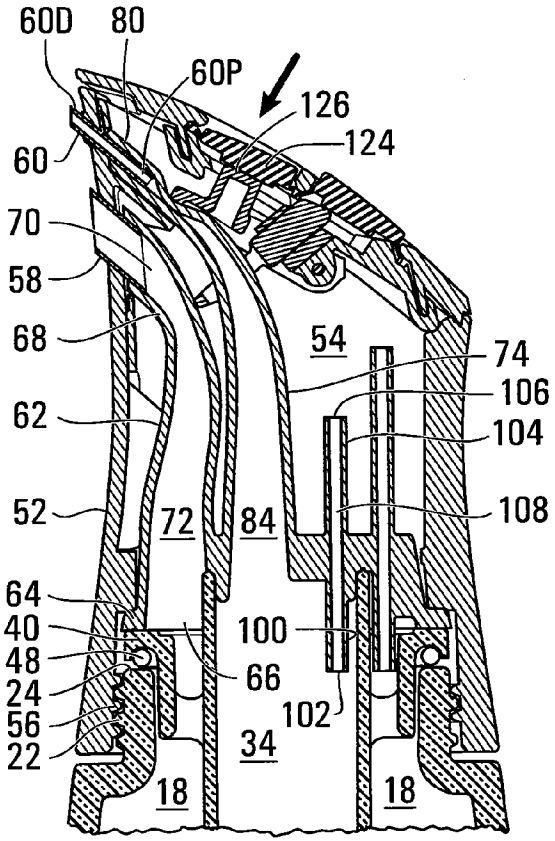
FIG. 4B is a cross-sectional view of the dispenser of FIG. 1 wherein the valve for stopping dispensing of the oil is depressed.
Figure 4A:
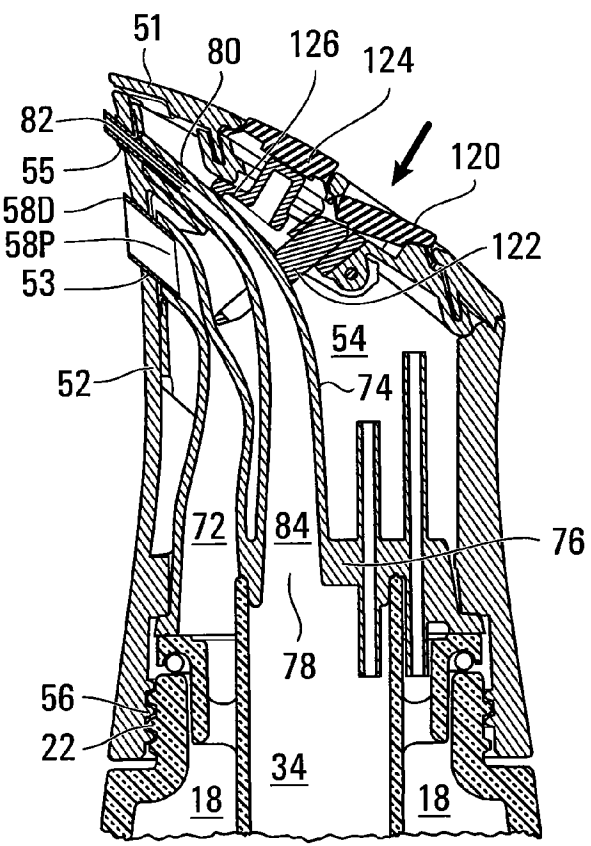
FIG. 4A is a cross-sectional view of the dispenser of FIG. 1 wherein the valve for stopping dispensing of the vinegar is depressed.

The dispenser 10 further comprises an inner container 28 having a bottom wall 30 and a peripheral wall 32 defining an internal space 34 for receiving the vinegar. The inner container 28 also comprises a plurality of arms 36 that project outwardly from the peripheral wall 32 and a peripheral ring 38 having a shoulder 40 projecting outwardly at its top end and being located above the top rim 24 of the outer container 12. The inner container 28 has therefore a plurality of openings 42 defined between the peripheral wall 32, arms 36 and peripheral ring 38. As shown in FIGS. 3, 4A, 4B, the inner container 28 has a top rim 44 with a portion located above the shoulder 40 and defining an opening 46. While two arms 36 are shown in FIG. 3, it is understood that the inner container can have a plurality of arms (four or five arms for example) that extend from the peripheral wall 32 up to the peripheral ring 38 for defining the plurality of openings 42 between the peripheral wall 32, arms 36 and peripheral ring 38 wherein the openings 42 allow passage of the oil contained in the internal space 18 of the outer container 12 when the dispenser is tilted.

The dispenser 10 also comprises a seal (O-ring/gasket) 48 encircling the peripheral ring 38 and mounted between the upper surface of the top rim 24 of the outer container 12 and the bottom surface of the shoulder 40 of the inner container 28 so as to create a seal between the outer and inner containers 12, 28.

The dispenser 10 has a cap 50 comprising a top wall 51 and a peripheral wall 52 for enclosing the neck 20 of the outer container 12 and the shoulder 40 of the inner container 28 and defining an internal space 54 inside the cap 50. The cap 50 also has internal threads 56 registering with the external threads 22 of the outer container 12 such that a user can screw and unscrew the cap 50 on the outer container 12. The peripheral wall 52 of the cap 50 further comprises first and second apertures 53, 55 within which first and second spouts 58, 60 are received. The first spout 58 has a distal end portion 58D projecting outwardly from the cap and a proximal end portion 58P located within the internal space 54 of the cap and the second spout 60 has a distal end portion 60D projecting outwardly from the cap and a proximal end portion 60P located within the internal space 54 of the cap. The cap may comprise a base having a slot for allowing communication between the internal space 54 of the cap 50 and the internal spaces 18, 34 of the outer and inner containers 12, 28.

The dispenser 10 also comprises a first tube 62 having a bottom end 64 defining a bottom opening 66 facing the internal space 18 of the outer container 12 and a top end 68 mounted around the first spout 58, the top end 68 defining a top opening 70. The first tube 62 therefore defines a first passage 72 allowing fluid communication between the internal space 18 and the atmosphere such that, in use, a user can dispense oil through the first passage 72 of the first tube 62 when the user tilts the dispenser 10.

The dispenser 10 also comprises a second tube 74 having a bottom end 76 defining a bottom opening 78 facing the internal space 34 of the inner container 28 and a top end 80 mounted around the second spout 60, the top end 80 defining a top opening 82. The second tube 74 therefore defines a second passage 84 allowing fluid communication between the internal space 34 and the atmosphere such that, in use, the user can dispense vinegar through the second passage 84 of the second tube 74 when the user tilts the dispenser 10.

The top end 68 of the first tube 62 may be mounted around the proximal end portion 58P of the first spout 58 and the top end 80 of the second tube 74 may be mounted around the proximal end portion 60P of the second spout 60.

The dispenser 10 also comprises a first aeration tube 86 having a bottom end 88 defining a bottom opening 90 facing the internal space 18 of the outer container 12 and a top end 92 located in the internal space 54 of the cap 50, the top end 92 defining a top opening 94. The first aeration tube 86 therefore defines a first air passage 96 such that, in use, when oil is dispensed through the first passage 72 of the first tube 62, air can also penetrate into the internal space 18 of the outer container 12 to replace the volume of oil being dispensed out. As a result, oil can dispense out through the first passage 72 of the first tube 62 smoothly, without the risk of bubbles interrupting the flow.

The dispenser 10 further comprises a second aeration tube 98 having a bottom end 100 defining a bottom opening 102 facing the internal space 34 of the inner container 28 and a top end 104 located in the internal space 54 of the cap 50, the top end 104 defining a top opening 106. The second aeration tube 98 therefore defines a second air passage 108 such that, in use, when vinegar is dispensed through the second passage 84 of the second tube 74, air can also penetrate into the internal space 34 of the inner container 28 to replace the volume of vinegar being dispensed out. As a result, vinegar can dispense out through the second passage 84 of the second tube 74 smoothly, without the risk of bubbles interrupting the flow.

The inner and outer containers 12, 28 may be made of transparent plastic or glass and the cap 50 may be made of aluminum, plastic or stainless steel.

Figure 5:
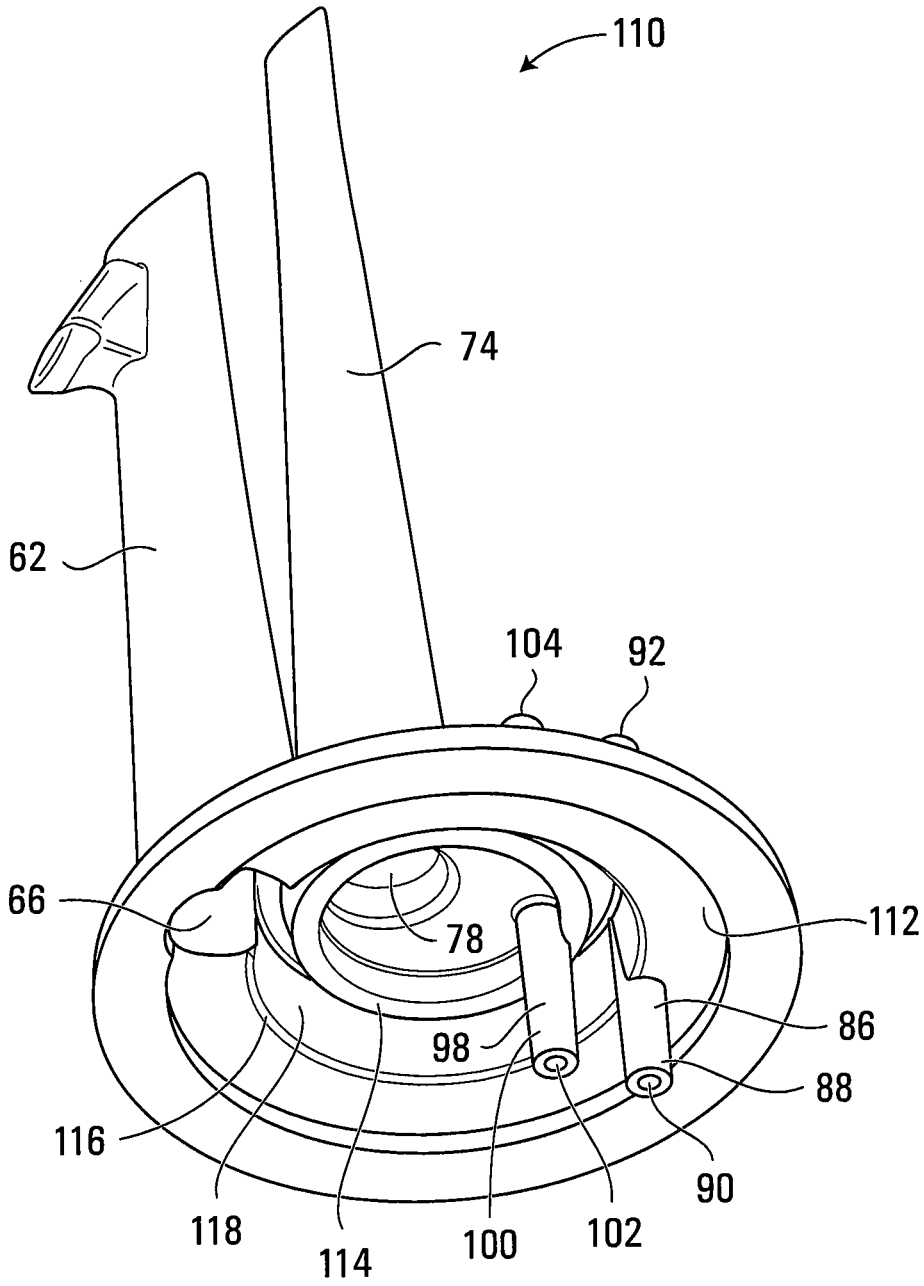
FIG. 5 is a perspective view of a unitary member integrating a tube for dispensing oil, a tube for dispensing vinegar and first and second aeration tubes.

As best shown in FIG. 5, the first and second tubes 62, 74 and the first and second aeration tubes 86 and 98 can be part of a unitary member 110 made of an elastomeric material such as food grade silicone.

The member 110 has a base 112 for covering the shoulder 40 of the inner container 28 and for overlapping the plurality of openings 42 and first and second inner peripheral walls 114, 116 defining therebetween a groove 118 for receiving the top rim 44 of the inner container 28. When the cap 50 has been attached to the outer container 12, an internal peripheral shoulder of the cap 50 presses against the periphery of the base 112 of the member 110 that is pushed against the upper surface of the shoulder 40 of the inner container so as to create a seal between the member 110 and the inner container 28. Due to the presence of the top rim 44 within the groove 118, when the user tilts the dispenser 10, the first and second tubes 62, 74 allow separate and simultaneous dispensing of oil and vinegar wherein the oil contained in the internal space 18 of the outer container 12 passes through the opening 26 of the outer container 12 and through at least one of the plurality of openings 42 such that the oil is directed towards the bottom opening 66 of the first tube 62 for allowing dispending of the oil through the first passage 72 of the first tube 62 while air can also penetrate into the internal space 18 of the outer container 12 via the first air passage 96 of the first aeration tube 92 and wherein the vinegar contained in the internal space 34 of the inner container 28 passes through the opening 46 of the inner container 28 and is directed towards the bottom opening 78 of the second tube 74 for allowing dispensing of the vinegar through the second passage 84 of the second tube 74 while air can also penetrate into the internal space 34 of the inner container 28 via the second air passage 108 of the second aeration tube 104.

The dispenser 10 also comprise a first valve for reducing flow of oil and a second valve for reducing flow of vinegar.

Referring to FIGS. 1 and 4A, the top wall 51 has a first actuator (push-button) 120 mounted in an aperture, the first actuator 120 being connected to a stem 122 wherein, upon pressure by the user on the first actuator 120, the stem 122 presses on the first tube 62 for reducing flow of oil via the first passage 72. The user can stop the flow of oil as shown in FIG. 4A.

Referring to FIGS. 1 and 4B, the top wall 51 has a second actuator (push-button) 124 mounted in another aperture, the second actuator 124 being connected to a pressing member 126, wherein, upon pressure by the user on the second actuator 124, the pressing member 126 presses on the second tube 74 for reducing flow of vinegar via the second passage 84. The user can stop the flow of vinegar as shown in FIG. 4B.

When the user releases pressure on the actuator 120 or 124, due to the resiliency of the material of the first and second tubes 62, 74, these tubes return to their original shape.

As shown in FIG. 3, the diameter of the first tube 62 reduces gradually from the bottom end 64 to the top end 68 such that the first tube 62 gradually tempers up to the top opening 70 in order to maximize the flow of the oil. Similarly, the diameter of the second tube 74 reduces gradually from the bottom end 76 to the top end 80 such that the second tube 74 gradually tempers up to the top opening 82 in order to maximize the flow of the vinegar.

While the diameter of the first tube 62 between the bottom and top ends 64, 68 may reduce of about 90% to 70%, the one of the second tube 74 between the bottom and top ends 76, 80 may reduce of about 40% to 10% such that different ratios between the oil and vinegar can be obtained when selecting the appropriate diameters and tempering of the first and second tubes 62, 74. For example, for the same diameter of the first and second tubes 62, 74 at the bottom, the length and tempering of the first and second tubes 62, 74 can be selected such that the ratio of oil for vinegar is from 6 for 1 up to 12 for 1.

In one embodiment, the diameter of the first tube 62 may be between 0.300" and 0.340" at the bottom end and between 0.195" and 0.235" at the upper end and the diameter of the second tube 74 may be between 0.293" and 0.333" at the bottom end and between 0.040" and 0.080" at the upper end and the length of the first tube 62 may be between 2.2" and 2.6" and the length of the second tube 74 may be between 2.8" and 3.2".

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. A dispenser for oil and vinegar, said dispenser comprising:

(a) an outer container having a bottom wall and a peripheral wall defining an internal space for receiving oil, said outer container having a top rim defining an opening;

(b) an inner container having a bottom wall and a peripheral wall defining an internal space for receiving vinegar, said inner container being at least partially located within said internal space of said outer container, said inner container having a shoulder projecting outwardly and being located above said top rim of said outer container;

(c) an external cap having a top wall and a peripheral wall for enclosing said top rim of said outer container and said shoulder of said inner container, said top wall and peripheral wall of said external cap defining an internal space;

(d) a first tube having a bottom end defining a bottom opening facing said internal space of said outer container and a top end defining a top opening opened to the atmosphere, wherein said first tube defines a first passage for allowing fluid communication between said internal space of said outer container and the atmosphere;

(e) a second tube having a bottom end defining a bottom opening facing said internal space of said inner container and a top end defining a top opening opened to the atmosphere, wherein said second tube defines a second passage for allowing fluid communication between said internal space of said inner container and the atmosphere; and (f) a finger-operated flow control actuator configured to, when a user tilts said dispenser, (i) allow separate and simultaneous dispensing of vinegar and oil through said first and second passages respectively when no finger pressure of the user is acting on said flow control actuator and (ii) progressively constrict said first tube or said second tube with increasing finger pressure applied on said flow control actuator to cause progressive reduction of flow of oil through said first passage of said first tube or flow of vinegar through said second passage of said second tube.

2. A dispenser as defined in claim 1, wherein said top rim of said outer container is provided on a neck of said outer container and wherein said neck has external threads.

3. A dispenser as defined in claim 1, wherein said shoulder of said inner container extends from a peripheral ring provided on said inner container and wherein said inner container further comprises a plurality of arms that project outwardly from said peripheral wall up to said shoulder such that said inner container has a plurality of openings defined between said peripheral wall, plurality of arms and peripheral ring.

4. A dispenser as defined in claim 1, wherein said shoulder of said inner container extends from a peripheral ring provided on said inner container and wherein said inner container has a top rim with a portion located above said shoulder of said inner container and defining an opening.

5. A dispenser as defined in claim 4, further comprising a seal encircling said peripheral ring of said inner container and mounted between said top rim of said outer container and said shoulder of said inner container.

6. A dispenser as defined in claim 2, wherein said external cap has internal threads registering with said external threads of said outer container such that the user can screw and unscrew said external cap on said outer container.

7. A dispenser as defined in claim 1, wherein said peripheral wall of said external cap has first and second apertures and said dispenser has first and second spouts received in said first and second apertures respectively, said first spout having a distal end portion projecting outwardly from said external cap and a proximal end portion located within said internal space of said external cap and said second spout having a distal end portion projecting outwardly from said external cap and a proximal end portion located within said internal space of said external cap.

8. A dispenser as defined in claim 7, wherein said first and second spouts are made of stainless steel.

9. A dispenser as defined in claim 7, wherein said top end of said first tube is mounted around said proximal end portion of said first spout and said top end of said second tube is mounted around said proximal end portion of said second spout.

10. A dispenser as defined in claim 4, further comprising a first aeration tube having a bottom end defining a bottom opening facing said internal space of said outer container and a top end defining a top opening located in said internal space of said external cap, wherein said first aeration tube defines a first air passage such that, in use, when oil is dispensed through said first passage of said first tube, air can also penetrate into said internal space of said outer container through said first air passage.

11. A dispenser as defined in claim 10, further comprising a second aeration tube having a bottom end defining a bottom opening facing said internal space of said inner container and a top end defining a top opening located in said internal space of said external cap, wherein said second aeration tube defines a second air passage such that, in use, when vinegar is dispensed through said second passage of said second tube, air can also penetrate into said internal space of said inner container through said second air passage.

12. A dispenser as defined in claim 11, wherein said first and second tubes and said first and second aeration tubes are part of a separate unitary member made of food grade silicone.

13. A dispenser as defined in claim 12, wherein said separate unitary member has a base covering said shoulder of said inner container and first and second inner peripheral walls defining therebetween a groove for receiving said top rim of said inner container such that in use, when the user tilts said dispenser, oil contained in said internal space of said outer container is directed towards said bottom opening of said first tube for allowing dispending of the oil through said first passage of said first tube while air can also penetrate into said internal space of said outer container through said first air passage and wherein vinegar contained in said internal space of said inner container is directed towards said bottom opening of said second tube for allowing dispensing of the vinegar through said second passage of said second tube while air can also penetrate into said internal space of said inner container through said second air passage.

14. A dispenser as defined in claim 1, wherein said finger-operated control actuator is a first actuator provided on said top wall of said external cap and said dispenser further comprises a stem connected to said first actuator, wherein, upon increasing finger pressure by the user on said first actuator, said stem presses on said first tube for progressively reducing flow of oil through said first passage of said first tube.

15. A dispenser as defined in claim 14, further comprising a second actuator provided on said top wall of said external cap and a pressing member connected to said second actuator, wherein, upon increasing finger pressure by the user on said second actuator, said pressing member presses on said second tube for progressively reducing flow of vinegar through said second passage of said second tube.

16. A dispenser as defined in claim 15, wherein said first actuator is located proximate said second actuator.

17. A dispenser as defined in claim 1, wherein said inner and outer containers are made of transparent plastic or glass.

18. A dispenser as defined in claim 1, wherein said external cap is made of aluminum, plastic or stainless steel.

19. A dispenser for oil and vinegar, said dispenser comprising:

(a) an outer container having a bottom wall and a peripheral wall defining an internal space for receiving oil, said outer container having a top rim defining an opening;

(b) an inner container having a bottom wall and a peripheral wall defining an internal space for receiving vinegar, said inner container being at least partially located within said internal space of said outer container, said inner container having a shoulder projecting outwardly and being located above said top rim of said outer container;

(c) an external cap having a top wall and a peripheral wall for enclosing said top rim of said outer container and said shoulder of said inner container, said top wall and peripheral wall defining an internal space;

(d) a first tube having a bottom end defining a bottom opening facing said internal space of said outer container and a top end defining a top opening opened to the atmosphere, wherein said first tube defines a first passage for allowing fluid communication between said internal space of said outer container and the atmosphere;

(e) a second tube having a bottom end defining a bottom opening facing said internal space of said inner container and a top end defining a top opening opened to the atmosphere, wherein said second tube defines a second passage for allowing fluid communication between said internal space of said inner container and the atmosphere;

(f) a first actuator provided on said top wall of said external cap and a stem connected to said first actuator; and (g) a second actuator provided on said top wall of said external cap and a pressing member connected to said second actuator;

wherein, in use, when a user tilts said dispenser, (i) said first and second tubes allow separate and simultaneous dispensing of oil and vinegar through said first and second passages respectively, (ii) wherein upon increasing finger pressure by the user on said first actuator, said stem presses on said first tube for progressively reducing flow of oil through said first passage of said first tube, and (iii) wherein upon increasing finger pressure by the user on said second actuator, said pressing member presses on said second tube for progressively reducing flow of vinegar through said second passage of said second tube.

20. A dispenser as defined in claim 19, further comprising first and second spouts received in first and second apertures provided in said peripheral wall of said external cap, said first spout having a distal end portion projecting outwardly from said external cap and a proximal end portion connected to said first tube, and said second spout having a distal end portion projecting outwardly from said external cap and a proximal end portion connected to said second tube.

21. A dispenser for oil and vinegar, said dispenser comprising:

(a) a container having a first chamber with a bottom wall and a peripheral wall defining an internal space for receiving vinegar and a second chamber having a bottom wall and a peripheral wall defining an internal space for receiving oil;

(b) a removable cap mounted on said container and having a top wall and a peripheral wall defining an internal space;

(c) a first tube having a bottom end defining a bottom opening facing said internal space of said first container and a top end defining a top opening opened to the atmosphere, wherein said first tube defines a first passage for allowing fluid communication between said internal space of said first container and the atmosphere;

(d) a second tube having a bottom end defining a bottom opening facing said internal space of said second container and a top end defining a top opening opened to the atmosphere, wherein said second tube defines a second passage for allowing fluid communication between said internal space of said second container and the atmosphere; and (e) a finger-operated flow control actuator configured to, when a user tilts said dispenser, (i) allow separate and simultaneous dispensing of vinegar and oil through said first and second passages respectively when no finger pressure of the user is acting on said flow control actuator and (ii) progressively constrict said first tube or said second tube with increasing finger pressure applied on said flow control actuator to cause progressive reduction of flow of vinegar through said first passage of said first tube or of oil through said second passage of said second tube.

22. A dispenser as defined in claim 21, wherein said finger-operated flow control actuator comprises a push-button provided on said top wall of said removable cap and said dispenser further comprises a pressing member connected to said push-button, wherein, upon increasing finger pressure by the user on said push-button, said pressing member presses on said first tube for progressively reducing flow of vinegar through said first passage of said first tube.

23. A dispenser as defined in claim 22, wherein said push-button is a first push-button and said finger-operated flow control actuator further comprises a second push-button provided on said top wall of said removable cap and a stem connected to said second push-button, wherein, upon increasing finger pressure by the user on said second push-button, said stem presses on said second tube for progressively reducing flow of oil through said second passage of said second tube.

24. A dispenser as defined in claim 21, wherein said finger-operated flow control actuator comprises first and second push-buttons and said dispenser is configured such that it can be grasped with one hand of the user and wherein said first and second push-buttons are located side by side on said top wall of said removable cap such that they can be operated by an index finger of the user's hand holding said dispenser.

25. A dispenser as defined in claim 21, further comprising a first aeration tube having a bottom end defining a bottom opening facing said internal space of said first chamber and a top end defining a top opening located in said internal space of said removable cap, wherein said first aeration tube defines a first air passage such that, in use, when vinegar is dispensed through said first passage of said first tube, air can also penetrate into said internal space of said first chamber through said first air passage.

26. A dispenser as defined in claim 25, further comprising a second aeration tube having a bottom end defining a bottom opening facing said internal space of said second chamber and a top end defining a top opening located in said internal space of said removable cap, wherein said second aeration tube defines a second air passage such that, in use, when oil is dispensed through said second passage of said second tube, air can also penetrate into said internal space of said second chamber through said second air passage.

* * * * *